US010584502B2

(12) United States Patent
Simonson

(10) Patent No.: US 10,584,502 B2
(45) Date of Patent: Mar. 10, 2020

(54) ARCH-SUPPORT SYSTEM

(71) Applicant: Excel Project Management Ltd., Golden (CA)

(72) Inventor: Robert Simonson, Golden (CA)

(73) Assignee: Excel Project Management Ltd., Golden (CA)

( * ) Notice: Subject to any disclaimer, the term of this patent is extended or adjusted under 35 U.S.C. 154(b) by 489 days.

(21) Appl. No.: 15/260,526

(22) Filed: Sep. 9, 2016

(65) Prior Publication Data

US 2018/0073261 A1 Mar. 15, 2018

(51) Int. Cl.

| | |
|---|---|
| ***E21D 11/10*** | (2006.01) |
| ***E04G 21/18*** | (2006.01) |
| ***E04B 1/02*** | (2006.01) |
| *E04B 1/32* | (2006.01) |

(52) U.S. Cl.

CPC ..... *E04G 21/1866* (2013.01); *E04B 1/02* (2013.01); *E21D 11/10* (2013.01); *E04B 2001/3217* (2013.01)

(58) Field of Classification Search

CPC .. E04B 1/02; E04B 1/3205; E04B 2001/3217; E04G 21/1866; E04G 11/34; E21D 23/04; E21D 23/08; E21D 11/10; E21D 23/06; E21D 23/16; E21D 9/0621; E21D 11/30; E21D 15/14; E21D 23/03; E21D 23/0427; E21D 23/0086; E21D 11/28; E21D 11/40

See application file for complete search history.

(56) References Cited

U.S. PATENT DOCUMENTS

| | | | | |
|---|---|---|---|---|
| 1,992,785 A | | 2/1935 | Steuer | |
| 2,048,582 A | * | 7/1936 | Wetzig | F16L 1/038 425/63 |
| 2,671,697 A | * | 3/1954 | North | E04G 11/48 425/62 |
| 2,870,518 A | * | 1/1959 | Josef | B28B 7/30 425/63 |
| 3,138,933 A | * | 6/1964 | Kemper | E21D 19/00 405/142 |
| 3,206,824 A | * | 9/1965 | Cerutti | E21D 11/102 425/59 |
| 3,233,379 A | | 2/1966 | Zagray | |

(Continued)

FOREIGN PATENT DOCUMENTS

| | | |
|---|---|---|
| CA | 1203395 A | 4/1986 |
| CN | 203702207 | 7/2014 |

(Continued)

OTHER PUBLICATIONS

Lock-Block Ltd.; "Lock-BlockTM Units"; available online: http://www.lockblock.com/; 2014; 4 pages.

(Continued)

*Primary Examiner* — Gregory W Adams
(74) *Attorney, Agent, or Firm* — Miltons IP/p.i.

(57) ABSTRACT

An apparatus includes an arch-support system configured to support an archway above a work surface during construction of the archway. A rail assembly is configured to selectively receive and support the arch-support system in such a way that the rail assembly, in use, supports the arch-support system once the rail assembly selectively receives the arch-support system.

8 Claims, 8 Drawing Sheets

(56) References Cited

U.S. PATENT DOCUMENTS

| | | | | |
|---|---|---|---|---|
| 3,298,155 | A * | 1/1967 | Byfield | F27B 7/28 52/749.15 |
| 3,377,105 | A * | 4/1968 | Wallers | E21D 9/0873 299/11 |
| 3,534,518 | A | 10/1970 | Zagray | |
| 3,678,694 | A * | 7/1972 | Haspert | E21D 11/40 405/146 |
| 4,110,949 | A | 9/1978 | Cambiuzzi et al. | |
| 4,573,301 | A | 3/1986 | Wilkinson | |
| 4,586,889 | A * | 5/1986 | Krohne | E01C 19/40 249/219.1 |
| 4,590,729 | A | 5/1986 | Hegazi | |
| 4,808,030 | A * | 2/1989 | Takegawa | E21D 11/10 264/33 |
| 4,890,993 | A | 1/1990 | Wilson | |
| 4,930,937 | A * | 6/1990 | Fulton | E02D 29/045 16/32 |
| 5,421,135 | A | 6/1995 | Stevens et al. | |
| 5,586,841 | A | 12/1996 | Anderson et al. | |
| 5,623,797 | A | 4/1997 | Gravier et al. | |
| 5,794,921 | A | 8/1998 | Greenberg | |
| 5,890,332 | A | 4/1999 | Skidmore et al. | |
| 5,904,019 | A | 5/1999 | Kooij et al. | |
| 5,921,715 | A | 7/1999 | Rainey | |
| 6,065,263 | A | 5/2000 | Taguchi | |
| 6,088,987 | A | 7/2000 | Simmons et al. | |
| 6,089,792 | A | 7/2000 | Khamis | |
| 6,161,357 | A | 12/2000 | Altemus | |
| 6,397,549 | B1 | 6/2002 | Baldwin | |
| 6,557,818 | B2 | 5/2003 | Manthei | |
| 6,588,168 | B2 | 7/2003 | Walters | |
| 6,615,561 | B2 | 9/2003 | MacDonald et al. | |
| 6,857,240 | B1 | 2/2005 | MacAlister | |
| 7,328,537 | B2 | 2/2008 | Hammer | |
| 7,934,345 | B2 | 5/2011 | Marsh et al. | |
| 7,934,351 | B2 | 5/2011 | Clarno | |
| 8,099,918 | B2 | 1/2012 | Marsh et al. | |
| 8,171,693 | B2 | 5/2012 | Banova | |
| 8,549,811 | B2 | 10/2013 | Dyson | |
| 8,820,024 | B1 | 9/2014 | Abdullah et al. | |
| 8,887,469 | B2 | 11/2014 | MacDonald et al. | |
| 8,945,442 | B2 * | 2/2015 | Rosati | E04G 11/48 264/33 |
| 9,206,597 | B2 | 12/2015 | Marsh et al. | |
| 9,238,910 | B2 | 1/2016 | Jensen | |
| 9,315,992 | B2 | 4/2016 | Carey | |
| 2002/0001509 | A1 | 1/2002 | Hong | |
| 2002/0083658 | A1 | 7/2002 | Dial | |
| 2003/0126809 | A1 | 7/2003 | Hampton | |
| 2004/0237445 | A1 | 12/2004 | Kliethermes | |
| 2005/0108972 | A1 | 5/2005 | Banova | |
| 2005/0252123 | A1 | 11/2005 | Colonias | |
| 2008/0098687 | A1 | 5/2008 | Marsh et al. | |
| 2008/0256894 | A1 | 10/2008 | Marsh et al. | |
| 2009/0113835 | A1 | 5/2009 | Banova | |
| 2009/0151292 | A1 | 6/2009 | Sinclair, Sr. | |
| 2013/0036696 | A1 | 2/2013 | Moroschan | |
| 2014/0223848 | A1 | 8/2014 | Binhussain et al. | |

FOREIGN PATENT DOCUMENTS

| | | | |
|---|---|---|---|
| CN | 204059659 | U | 12/2014 |
| CN | 104790977 | A | 7/2015 |
| CN | 204511453 | U | 7/2015 |
| CN | 205171393 | U | 4/2016 |
| DE | 3319645 | A1 | 12/1984 |
| EP | 2894270 | A1 | 7/2015 |
| JP | S59109658 | A | 6/1984 |
| JP | H04277205 | | 10/1992 |
| JP | H0679914 | U | 11/1994 |
| JP | H11324599 | | 11/1999 |
| KR | 101540406 | B1 | 8/2015 |

OTHER PUBLICATIONS

World Block: Knob Style; "30×30×60"; available online: http://www.worldblock.com/; 5 pages.

Langley Concrete Group; "Highway Barriers and Parking Curbs" available online: http://www.langleyconcrete.calls.net/index.php?mact=Gallery,m6e73e,default,1&m6e73edir=Headwall%; 3 pages.

Evaluation Report No. 198; Allan Block Retaining Wall Systems; available online: http://www.allanblock.com/literature/PDF/ER_0198.pdf; Sep. 30, 2011; Revised Sep. 18, 2015; 16 pages.

Redi-Rock; "Concrete Retaining Wall System Freestanding Walls"; available online: https://www.redi-rock.com/concrete-block-systems-to-build-freestanding-walls.htm; 3 pages.

Formablok; "Build-your-own Concrete Blocks"; available online: http://www.formablok.com/; 1 page.

Redi-Rock; "Retaining Walls . . . Only Better"; available online: http://www.redi-rock.com/retaining-walls; 4 pages.

ConcreteNetwork.com; "Molds & Mold Rubbers in USA and Worldwide"; available online: http://www.concretenetwork.com/suppliers/MoldsMoldRubbers/usa-and-canada/; 1 page.

Europe Block; "Concrete Block Moulds"; available online: http://www.europeblock.com/en/concrete-block-moulds/?gclid=CPqcjJLjucMCFQinaQodGFwAdg; 1 page.

World Block: "V-Interlock"; available online: http://www.worldblock.com/v-interlock.html; 9 pages.

LMI—Leonard Marr, Inc.; "Blocks and Molds"; available online: http://www.leonardmarrinc.com/blocks_and_molds.html; 2 pages.

LMI—Leonard Marr, Inc. Brochure; "Interlocking Concrete Block Forms"; available online: http://www.leonardmarrinc.com/images/Full_Brochure.pdf; 16 pages.

Concrete Mixer Supply: "CF1000 Concrete Block Forms 2 Piece 2'×2'×6'"; available online: http://www.concretemixersupply.com/parts/cf1000-3/; 3 pages.

Alibaba; "QMR2-40 Channel Brick Making Machine, U Shape Brick Making Machine"; available online: http://www.alibaba.com/product-detail/QMR2-40-Channel-Brick-Making-Machine_1877522391.html?spm=a2700.7724857.29.66.0nBNfC; 3 pages.

* cited by examiner

ARCH-SUPPORT SYSTEM

TECHNICAL FIELD

This document relates to the technical field of (and is not limited to) an arch-support system configured to support an archway during construction of the archway.

BACKGROUND

An archway is the passage ("way") under an arch. The Romans introduced stone arch technology over two thousand years ago. They applied this technology to bridges they constructed across the known world, and examples of it may still be seen today. The technology they used has stood the test of time and some Roman construction methods are still used today. One example of these construction technologies is the wood frame, which was constructed in the shape of an arch. The stone work (arch) was built up around the frame, and finally a keystone was set in position. The wood frame was then removed, and the arch was left in position. Stone arch technology was used even on Roman monuments such as the Colosseum in Rome. Many of the monuments built with stone arch technology can still be seen today (due to the strength of the arch).

SUMMARY

It will be appreciated that there exists a need to mitigate (at least in part) at least one problem associated with the existing systems for constructing archways (also called the existing technology). After much study of the known systems and methods with experimentation, an understanding of the problem and its solution has been identified and is articulated as follows:

Existing systems do not provide enough flexibility for assisting in the construction of archways.

To mitigate, at least in part, at least one problem associated with the existing technology, there is provided (in accordance with a major aspect) an apparatus. The apparatus includes an arch-support system configured to support an archway above a work surface during construction of the archway. A rail assembly is configured to selectively receive and support the arch-support system in such a way that the rail assembly, in use, supports the arch-support system once the rail assembly selectively receives the arch-support system.

To mitigate, at least in part, at least one problem associated with the existing technology, there is provided (in accordance with a major aspect) an apparatus. The apparatus includes an arch-support system configured to support an archway above a work surface during construction of the archway while allowing unimpeded movement below the archway during construction of the archway. The arch-support system includes a telescoping base section having an upper base section and a lower base section spaced apart from the upper base section, in which the lower base section is configured to be securely mounted to the work surface. This is done in such a way that the telescoping base section extends upwardly from the work surface once the lower base section is securely mounted to the work surface. An intermediate section has an upper intermediate section and a lower intermediate section spaced apart from the upper intermediate section, in which the lower intermediate section is configured to be securely affixed to the upper base section of the telescoping base section. This is done in such a way that the intermediate section extends upwardly from the telescoping base section once (A) the lower intermediate section is securely affixed to the upper base section of the telescoping base section, and (B) the lower base section is securely mounted to the work surface. An arch-support section is configured to be securely affixed to the upper intermediate section of the intermediate section. This is done in such a way that the arch-support section is spaced apart from the work surface once the arch-support section is securely affixed to the upper intermediate section of the intermediate section, and the arch-support section being configured to securely support construction of the archway in such a way that the arch-support section is removable from the archway, once construction of the archway is completed and the archway is self-supporting. A rail assembly is configured to selectively receive and support the telescoping base section in such a way that the rail assembly, in use, supports movement of the telescoping base section relative to the archway once the rail assembly selectively receives the telescoping base section.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
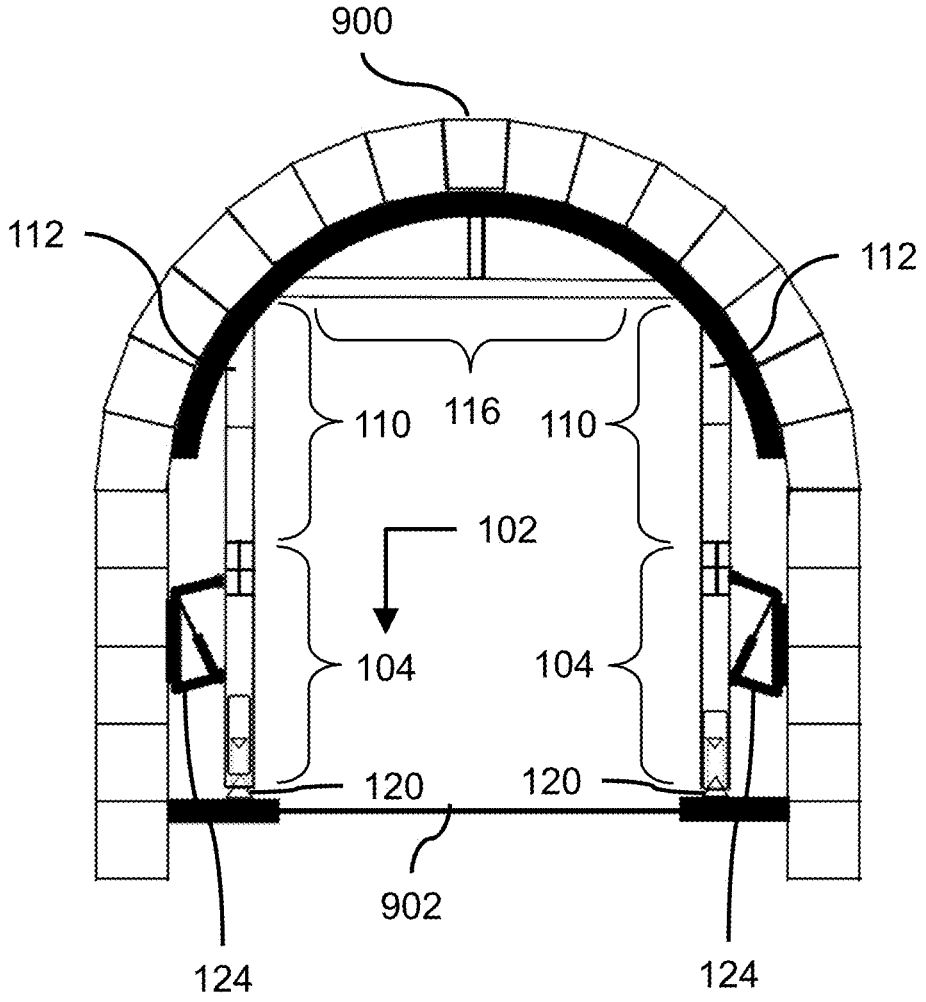
FIG. 1 depicts an end view of an embodiment of an apparatus including an arch-support system.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

102 arch-support system
104 telescoping base sections
106 upper base section
108 lower base section
110 intermediate section
112 upper intermediate section
114 lower intermediate section
116 arch-support section
118 spaced-apart lift actuators
120 rail assembly (also called a V-rail assembly)
122 spaced-apart wheels
124 bracing assembly
126 safety railing assembly
128 spaced-apart horizontal beams
130 spaced apart vertical beams
132 cross-supporting structure
134 spaced-apart wheel lift actuators (also called optional bearing and bushing solid mount system)
135 spaced-apart wheel mounting bushings and thrust bearings
136 vertically-extending spaced-apart telescoping tubular sections
138 outer tube section
140 inner tube section, threaded inner tube section, or grooved inner tube section
141 unthreaded tube section
142 safety lock assembly
144 manual and lockable safety shut off valve
900 archway
902 work surface

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of may be defined by the claims (in which the claims may be amended during patent examination after filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described.

FIG. 1 depicts an end view of an embodiment of an apparatus including an arch-support system 102.

Referring to a general embodiment as depicted in FIG. 1, the apparatus includes (and is not limited to) a synergistic combination of the arch-support system 102 and a rail assembly 120.

The arch-support system 102 is configured to support an archway 900 above a work surface 902 during construction of the archway 900. The rail assembly 120 is configured to selectively receive and support the arch-support system 102. This is done in such a way that the rail assembly 120, in use, supports the arch-support system 102 once the rail assembly 120 selectively receives the arch-support system 102.

In accordance with an embodiment, the arch-support system 102 includes a synergistic combination of (A) an arch-support section 116 configured to securely support construction of the archway 900, and (B) a telescoping base section 104 configured to move the arch-support section 116 relative to the archway 900. The rail assembly 120 is configured to selectively receive and support the telescoping base section 104 in such a way that the rail assembly 120, in use, supports movement of the telescoping base section 104 relative to the archway 900 once the rail assembly 120 selectively receives the telescoping base section 104.

More specifically, referring to the embodiment as depicted in FIG. 1, the arch-support system 102 includes (and is not limited to) a synergistic combination of a telescoping base section 104, an intermediate section 110, an arch-support section 116, and a rail assembly 120.

With reference to all of the FIGS., and starting with FIG. 1, the arch-support system 102 is configured to support an archway 900 above a work surface 902 during construction of the archway 900 while allowing unimpeded movement below the archway 900 (such as, traffic or water flow) during construction of the archway 900. The archway 900 is to be constructed over (above) a work surface 902. The arch-support system 102 is configured to require a relatively shorter set-up time, and a relatively shorter demobilization time after completion of the construction of the archway 900. The arch-support system 102 is configured to allow sectional construction of a length of the archway 900. The arch-support system 102 is configured to allow the archway 900 to be curved and/or to change grade as well. The arch-support system 102 is modular and may be constructed in a desired length, with additional sections that may be attached to each other to allow construction of longer instances of the archway 900. The arch-support system 102 is configured to provide modular components to facilitate transportation. The arch-support system 102 is configured to assist in the construction of the archway 900 forming various radiuses, heights, lengths, curvatures and/or formed tunnels positioned underneath the archway 900. The arch-support system 102 may include rolled steel structural elements filled in with either steel plate and/or fine mesh expanded metal screening or a combination of both. This is to ensure that tools, materials or construction debris do not fall under the arch-support system 102 onto the work surface 902 positioned directly below the archway 900. Preferably, each section of the arch-support system 102 includes removable hand railings that may have expanded metal screening (or any other equivalent material or system) positioned between the structural elements (to ensure that tools, materials or construction debris do not fall under the arch-support system 102). Preferably, the arch-support system 102 includes hand railings that may be removed from the arch-support system 102 to allow the arch-support system 102 to be moved in order to assist in the construction of the next section of the archway 900, or for removal from the construction site after completion. The arch-support system 102 is configured to be movable for building free-standing archways. The arch-support system 102 is configured to support the placement of the blocks of the archway 900 until the key block is positioned in place. Once the key block is placed, the archway 900 becomes self-supporting, and the arch-support system 102 may be moved away from the archway 900. The arch-support system 102 is configured to be lowered and moved to the next position, and raised toward a section of the archway 900 to be constructed, so that construction work may continue on the next section of the archway 900.

Referring to the embodiment as depicted in FIG. 1, the telescoping base section 104 is also called a lift base telescoping section. The telescoping base section 104 has an upper base section 106 (as depicted in FIGS. 3, 4, 5 and 6) and a lower base section 108 (as depicted in FIGS. 3, 4, 5 and 6) that is spaced apart from the upper base section 106. The lower base section 108 is configured to be securely mounted to the work surface 902. This is done in such a way that the telescoping base section 104 extends upwardly from the work surface 902 once the lower base section 108 is securely mounted to the V-shaped rail assembly 120 positioned on the work surface 902. Preferably, the telescoping base section 104 includes a locking device which is depicted in FIG. 5 as any one of or both the safety lock assembly 142 and the manual and lockable safety shut off valve 144 configured to prevent accidental movement (lowering, raising, vertical movement and/or horizontal movement) of the telescoping base section 104 during the construction of the archway 900 (in the event of a component failure and/or human error). A combination of safety lock assemblies and manual and lockable safety shut off valves are configured to prevent accidental movement of the telescoping base section during the construction of the archway.

Referring to the embodiment as depicted in FIG. 1, the intermediate section 110 has an upper intermediate section 112 (as depicted in FIGS. 3, 4, 5 and 6) and a lower intermediate section 114 (as depicted in FIGS. 3, 4, 5 and 6) that is spaced apart from the upper intermediate section 112. The lower intermediate section 114 is configured to be securely affixed to the upper base section 106 of the telescoping base section 104. This is done in such a way that the intermediate section 110 extends upwardly from the telescoping base section 104 once (A) the lower intermediate section 114 is securely affixed to the upper base section 106 of the telescoping base section 104, and (B) the lower base section 108 is securely mounted to the work surface 902.

Figure 2:
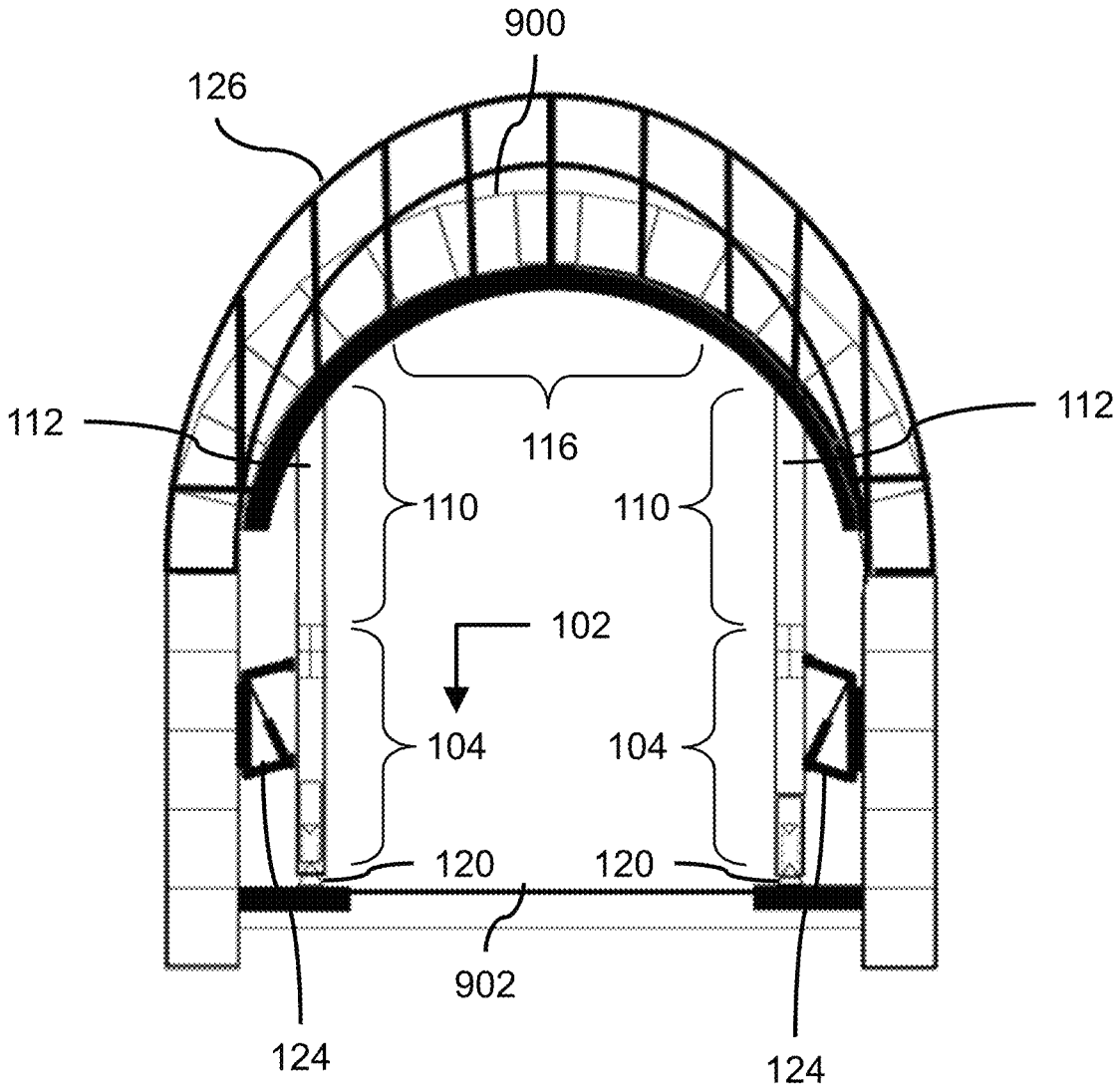
FIG. 2 depicts an end view of an embodiment of the arch-support system of FIG. 1.

Referring to the embodiment as depicted in FIG. 1, the arch-support section 116 is configured to be securely affixed to the upper intermediate section 112 of the intermediate section 110 (as depicted in FIGS. 1 and 2). This is done in such a way that the arch-support section 116 is spaced apart from the work surface 902 once the arch-support section 116 is securely affixed to the upper intermediate section 112 of the intermediate section 110. The arch-support section 116 is configured to securely support construction of the archway 900 in such a way that the arch-support section 116 is removable from the archway 900 once construction of the archway 900 is completed and the archway 900 is self-supporting. The telescoping base section 104 and the intermediate section 110 are configured to be combined in such a way that the telescoping base section 104 and the intermediate section 110 hold and support the arch-support section 116 in position relative to the archway 900. The weight of the archway 900 is received by the arch-support section 116. The weight of the archway 900 and the arch-support section 116 is, in turn, received by the combination of the telescoping base section 104 and the intermediate section 110. Preferably, the arch-support section 116 is configured to be arched (curved). More preferably, the arch-support section 116 is configured to be arched (curved) in such a way that the arch-support section 116 (in use) matches the curvature of the archway 900. Preferably, the arch-support section 116 is configured to match an archway radius of the archway 900. The archway 900 and the arch-support section 116 (to be fully constructed) are held and supported in position (the raised position above the work surface) while the archway 900 (or the section of the archway 900) is under construction. Once a section of archway 900 is completed, the telescoping base section 104 is configured to lower the arch-support section 116 away from the archway 900, and then the telescoping base section 104 may be removed (rolled out and away) from the archway 900. Then, an additional section of the archway 900 may be constructed, or the telescoping base section 104 (and other components, etc.) may be removed from the construction site. Preferably, the arch-support section 116 is fabricated to produce a desired arch size. Preferably, the arch-support section 116 is configured to be bolted (affixed) to the upper intermediate section 112 of the intermediate section 110. The arch-support section 116 is configured to (A) match the shape of the archway 900, and (B) hold or support the required load of the archway 900 until a section of the archway 900 is completed and self-supporting.

In accordance with the embodiments as depicted in FIGS. 1 and 2, two instances of the telescoping base section 104 are spaced apart from each other (and face each other), and two instances of the intermediate section 110 are spaced apart from each other (and face each other). The arch-support section 116 is configured to be connected to (affixed to), and to span across, the two instances of the intermediate section 110 that are spaced apart from each other. In accordance with an option, the telescoping base section 104 includes spaced-apart telescoping base sections 104, and the arch-support section 116 is configured to be connected to (affixed to), and to span across, the spaced-apart telescoping base sections 104.

In accordance with an embodiment as depicted in FIG. 5, the apparatus is adapted such that spaced-apart lift actuators 118 (also called hydraulic lift cylinders or spaced-apart lift assemblies, which may be either a single acting cylinder or a double acting cylinder) are affixed to the telescoping base section 104. This is done in such a way that the spaced-apart lift actuators 118 are configured to move the telescoping base section 104 along any one of an upward direction and a downward direction relative to the work surface 902 once the spaced-apart lift actuators 118 are affixed to the lower base section 108 of the telescoping base section 104.

In accordance with the embodiments as depicted in FIGS. 1-6, the apparatus is adapted such that a rail assembly 120 is configured to selectively receive and support the telescoping base section 104. This is done in such a way that the rail assembly 120, in use, supports the telescoping base section 104 once the rail assembly 120 selectively receives the telescoping base section 104. Preferably, the rail assembly 120 is configured to contact and extend along the work surface 902. This is done in such a way that the rail assembly 120 extends along the work surface 902 underneath the archway 900 once the rail assembly 120, in use, contacts the work surface 902. Preferably, the rail assembly 120 forms (includes) V-shaped spaced-apart rails. The rail assembly 120 is configured to support and maintain the telescoping base section 104 in the correct (desired) position underneath the archway 900. The rail assembly 120 may be positioned by being bolted (connected) to a concrete base, by being fixedly mounted on rig mat-type supports, or any equivalent system. Preferably, the telescoping base section 104 forms or provides a corresponding V-shaped groove configured to make positive contact with the V-shaped rails of the rail assembly 120. In this manner, the telescoping base section 104 is positioned in a stationary position (relative to the work surface) on the rail assembly 120 (that is, once the telescoping base section 104 is lowered onto and received by the rail assembly 120). Generally, the telescoping base section 104 is configured to selectively mate with the rail assembly 120 in such a way that the telescoping base section 104 is selectively maintained in a stationary position relative to the rail assembly 120.

Figure 3:
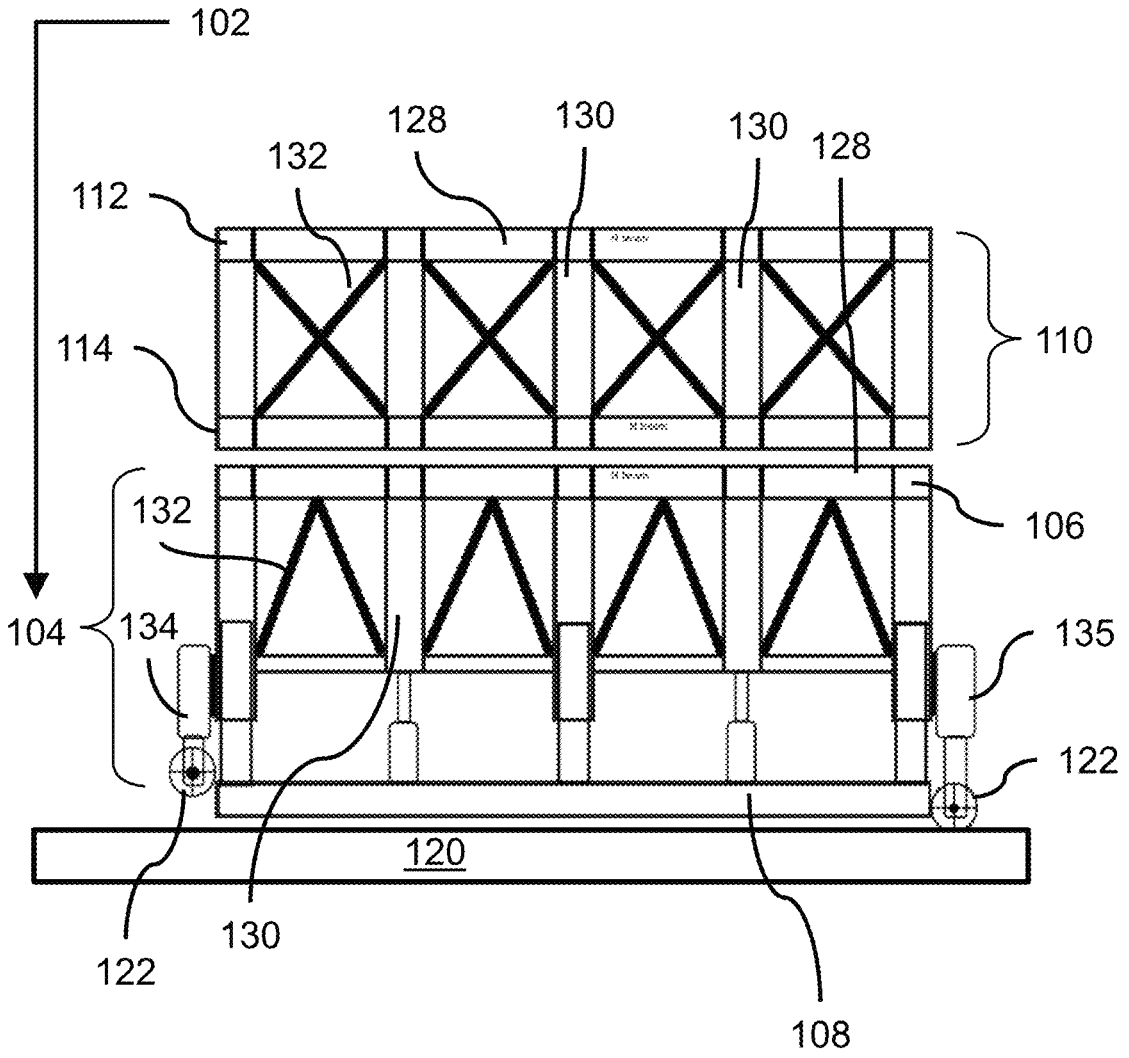
FIG. 3 depicts a side view of an embodiment of the arch-support system of FIG. 1.

In accordance with the embodiments as depicted in FIGS. 1-6, the apparatus is adapted such that spaced-apart wheels 122 are affixed to the lower base section 108 of the telescoping base section 104. The spaced-apart wheels 122 are configured to make rolling engagement with the rail assembly 120 (as depicted on the right-hand side of FIG. 3). This is done in such a way that the spaced-apart wheels 122, in use, permit horizontal rolling movement of the telescoping base section 104 along the rail assembly 120 once the spaced-apart wheels 122 engage the rail assembly 120. Preferably, the spaced-apart wheels 122 are attached to the spaced-apart wheel lift actuators 134 that are supported by the telescoping base section 104. The spaced-apart wheel lift actuators 134 are configured to respectively lower and raise the spaced-apart wheels 122 relative to the rail assembly 120. The spaced-apart wheels 122 are configured to be lowered (moved relative to) toward the rail assembly 120. The spaced-apart wheels 122 may be affixed to (mounted to) spaced-apart shafts and bushings 135 (also called spaced-apart support bushings and thrust bearings, as depicted in FIG. 3, and in detail drawing of FIG. 8. This arrangement allows the selective movement of the telescoping base section 104 relative to the archway 900 (when needed) into a predetermined position, thereby allowing or facilitating the construction of, for instance, a section of the archway 900, and/or allowing or facilitating the selective movement of the telescoping base section 104, for instance, for the construction of other (additional) sections of the archway 900 (as needed). When the telescoping base section 104 has been positioned at a desired location (along the rail assembly 120), the spaced-apart wheels 122 are lifted away from the rail assembly 120, and the telescoping base section 104 may then settle onto (and be supported by) the rail assembly 120 (which preferably includes a V-shaped spaced apart rails) in a relatively stationary position (relative to the work surface). In this manner, the telescoping base section 104 is securely locked in a stationary position relative to the archway 900. Preferably, the spaced-apart wheels 122 are configured to be locked in such a way that the spaced-apart wheels 122 are lifted away from the rail assembly 120 and the telescoping base section 104 contacts and rests on the rail assembly 120.

In accordance with the embodiments as depicted on the left-hand side of FIG. 3, the apparatus is adapted such that the spaced-apart wheels 122 are configured to be locked. This is done in such a way that once the spaced-apart wheels 122 are locked, the telescoping base section 104 is stationary relative to the rail assembly 120. The spaced-apart wheels 122 are also configured to be unlocked (as depicted on the right-hand side of FIG. 3). This is done in such a way that once the spaced-apart wheels 122 are unlocked, the telescoping base section 104 is mobile relative to the rail assembly 120.

In accordance with the embodiments as depicted in FIGS. 1, 2, 4 and 6, the apparatus is adapted such that a bracing assembly 124 (also called a hydraulic bracing cylinder and pivot arms) is configured to be coupled to the telescoping base section 104. The bracing assembly 124 is configured to brace the telescoping base section 104 against a stationary section of the archway 900 (as depicted in FIGS. 1 and 2). This is done in such a way that the bracing assembly 124, in use, prevents the lateral movement of the telescoping base section 104 relative to the work surface 902. The bracing assembly 124 is affixed to the side sections of the telescoping base section 104. The bracing assembly 124 is configured to position the telescoping base section 104 relative to the archway 900. The bracing assembly 124 is configured to prevent lateral movement of the telescoping base section 104 during construction of the archway 900.

FIG. 2 depicts an end view of an embodiment of the arch-support system 102 of FIG. 1.

In accordance with the embodiments as depicted in FIG. 2, the arch-support system 102 further includes a safety railing assembly 126 that is affixed to, and span across (at least in part), the arch-support section 116.

FIG. 3 depicts a side view of an embodiment of the arch-support system 102 of FIG. 1.

In accordance with the embodiments as depicted in FIG. 3, the telescoping base section 104 and the intermediate section 110 each includes spaced-apart horizontal beams 128 and spaced-apart vertical beams 130 affixed to the spaced-apart horizontal beams 128 to form a matrix-like support structure. A cross-supporting structure 132 interconnects the spaced-apart horizontal beams 128 and the spaced-apart vertical beams 130 (to further support the components of the telescoping base section 104).

Spaced-apart wheel lift actuators 134 are respectively coupled to the spaced-apart wheels 122. The spaced-apart wheel lift actuators 134 are configured to respectively move the spaced-apart wheels 122 up or down relative to the rail assembly 120. Referring to the left-hand side of FIG. 3, the spaced-apart wheel lift actuators 134 have moved the spaced-apart wheels 122 away from the rail assembly 120. Referring to the right-hand side of FIG. 3, the spaced-apart wheel lift actuators 134 have moved the spaced-apart wheels 122 toward (and into contact with) the rail assembly 120. Alternatively, the spaced-apart wheel lift actuators 134 may be replaced with spaced-apart bushings 135 (also called support bushings and thrust bearings), if so desired. The spaced-apart bushings 135 are not configured to move (directly move) the spaced-apart wheels 122 relative to the rail assembly 120, or relative to the work surface.

Preferably, the spaced-apart lift actuators 118 are affixed to the lower base section 108 of the telescoping base section 104. The spaced-apart lift actuators 118 (hydraulic cylinders) are coupled to the telescoping base section 104. The spaced-apart lift actuators 118 are configured to lift and lower the telescoping base section 104 relative to the work surface 902 (away from the rail assembly 120 or toward the rail assembly 120).

Figure 4:
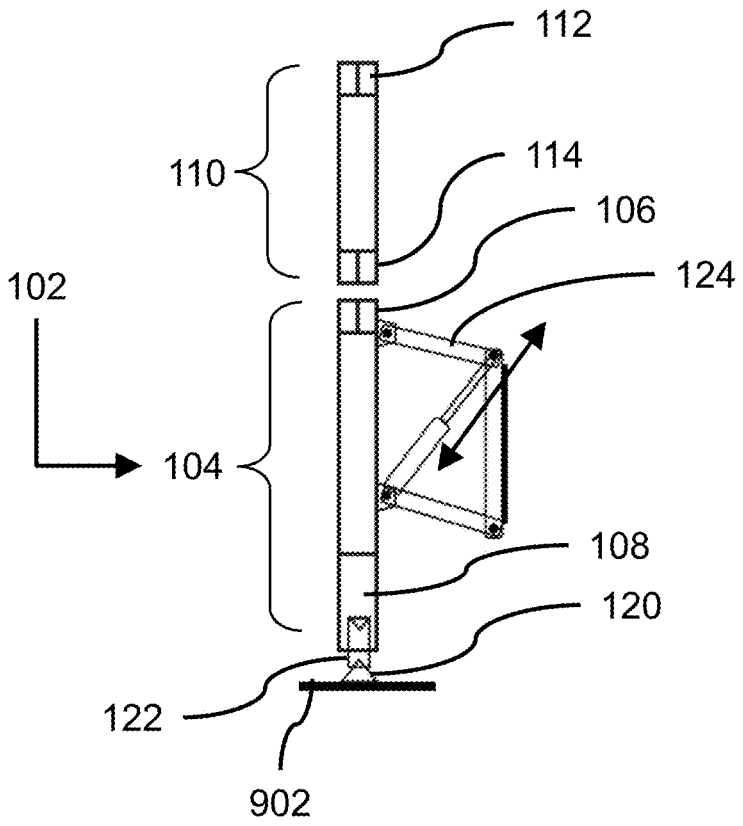
FIG. 4 depicts an end view of an embodiment of the arch-support system of FIG. 3.
Figure 5:
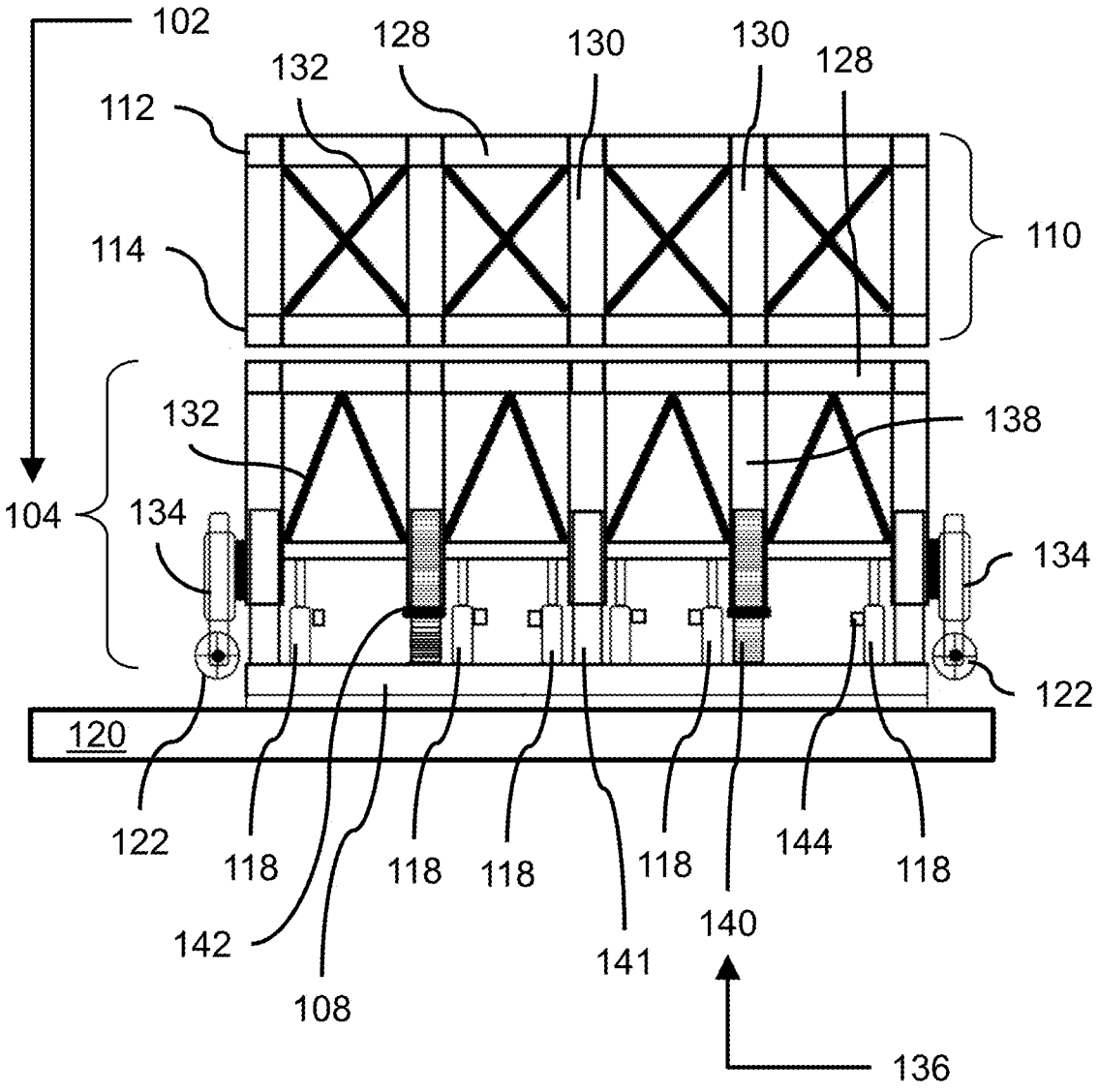
FIG. 5 depicts a side view of an embodiment of the arch-support system of FIG. 1.

FIG. 4 depicts an end view of an embodiment of the arch-support system 102 of FIG. 3.

In accordance with the embodiments as depicted in FIG. 4, the bracing assembly 124 includes a hydraulic cylinder configured to selectively move pivoting arms.

FIG. 5 depicts a side view of an embodiment of the arch-support system 102 of FIG. 1.

In accordance with the embodiments as depicted in FIG. 5, the spaced-apart wheel lift actuators 134 are positioned at opposite sides of the telescoping base section 104. Preferably, the spaced-apart wheels 122 are configured to be respectively pivoting or rotatable about a longitudinal axis that extends through the spaced-apart wheel lift actuators 134. Alternatively, the spaced-apart wheels 122 may be mounted to spaced-apart bushings 135 (as depicted in FIG. 3 and in the detail drawing of FIG. 8).

The telescoping base section 104 further includes vertically-extending spaced-apart telescoping tubular sections 136. The vertically-extending spaced-apart telescoping tubular sections 136 each includes an outer tube section 138 and an inner tube section 140 (which is also called a threaded inner tube section). The inner tube section 140 may include a threaded inner tube section or a grooved inner tube section, etc. The inner tube section 140 and the outer tube section 138 are threadably engaged with each other. In accordance with an option, the inner tube section 140 includes an unthreaded inner tube section 141 or a grooved inner tube section.

A safety lock assembly 142 (also called a lock nut or a split lock nut) is provided with each of the vertically-extending spaced-apart telescoping tubular threaded sections 136. The safety lock assembly 142 is configured to selectively lock out (selectively prevent) vertical height adjustment of the vertically-extending spaced-apart telescoping tubular sections 136.

The spaced-apart lift actuators 118 may include a double-acting hydraulic cylinder. A manual and lockable safety shut off valve 144 is provided with each of the spaced-apart lift actuators 118.

Figure 6:
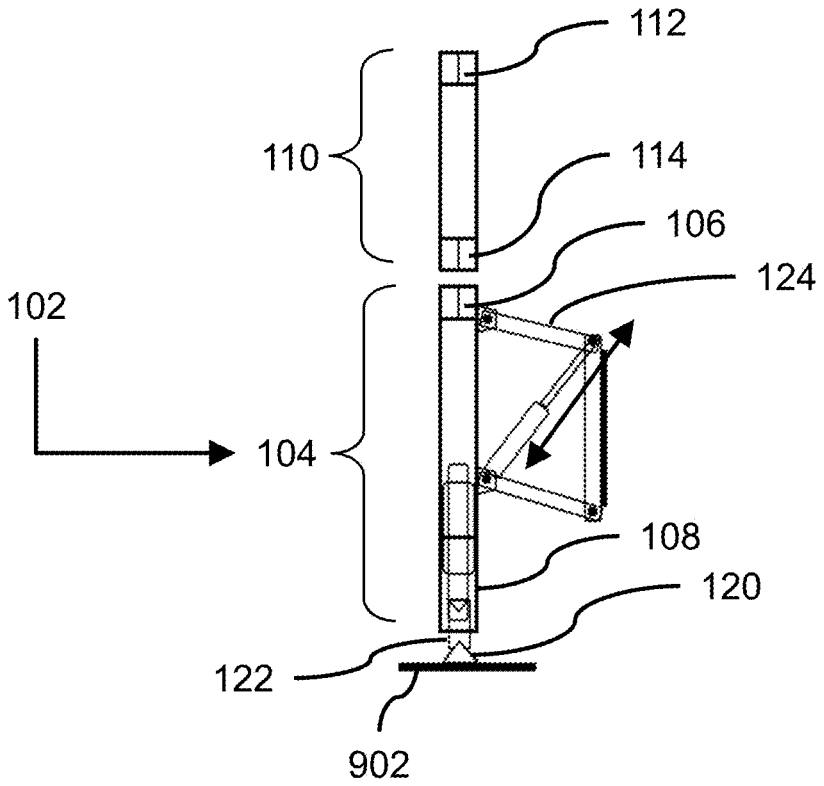
FIG. 6 depicts an end view of an embodiment of the arch-support system of FIG. 5.

FIG. 6 depicts an end view of an embodiment of the arch-support system 102 of FIG. 5.

In accordance with the embodiments as depicted in FIG. 6, the bracing assembly 124 includes a pivot arm positioning and stabilizing assembly.

Figure 7:
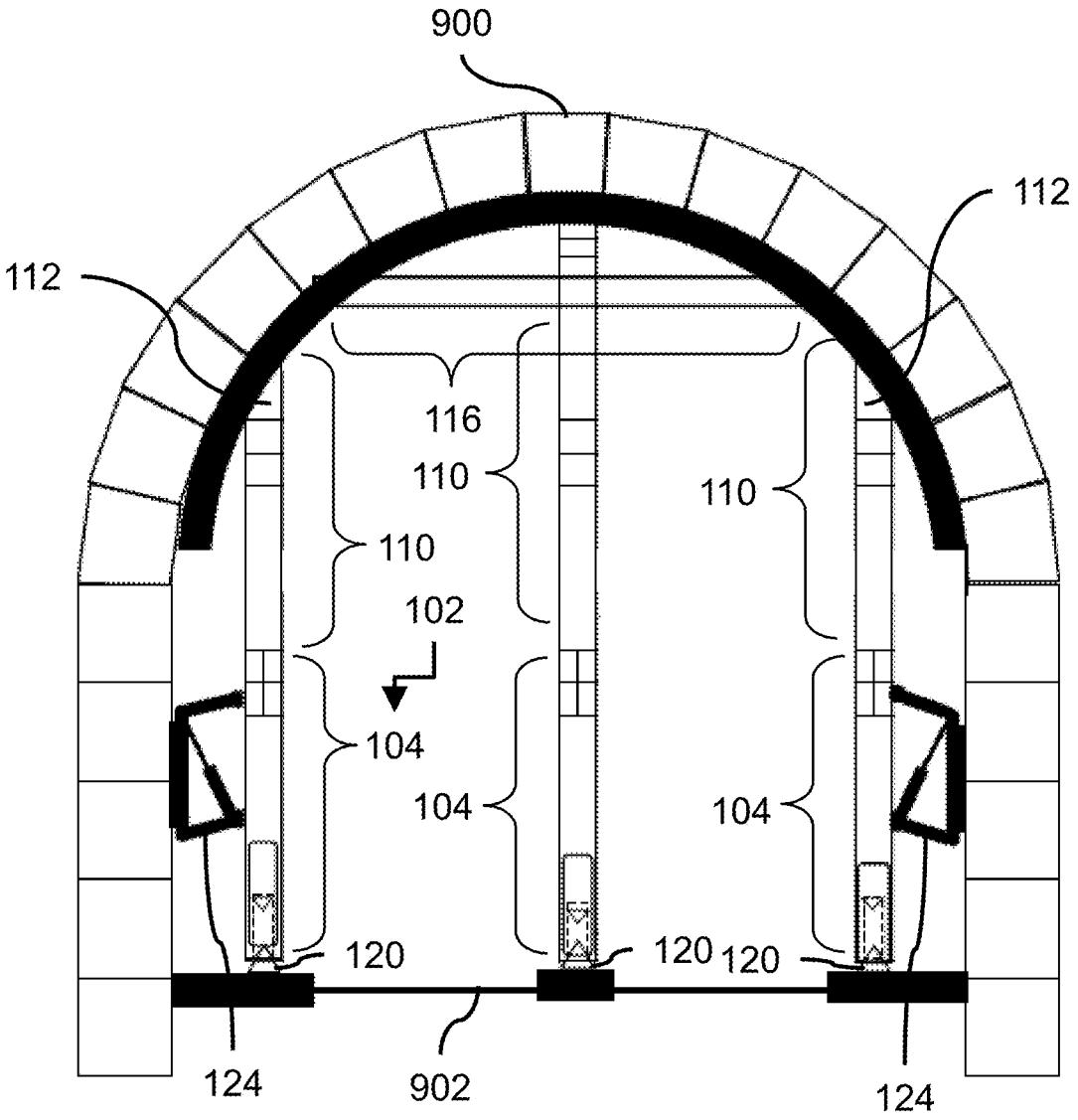
FIG. 7 depicts an end view of an embodiment of the arch-support system of FIG. 1.

FIG. 7 depicts an end view of an embodiment of the arch-support system 102 of FIG. 1.

In accordance with the embodiment as depicted in FIG. 7, the telescoping base section 104 is coupled to the intermediate section 110 in such a way that the combination of the telescoping base section 104 and the intermediate section 110 forms a vertical column extending between the work surface 902 and the arch-support section 116. There are spaced-apart vertical columns, which are formed by the combination of the telescoping base section 104 and the intermediate section 110, in which spaced-apart vertical columns are placed beneath the arch-support section 116 and along a length of the arch-support section 116. The vertically-extending column may be called a support structure.

Figure 8:
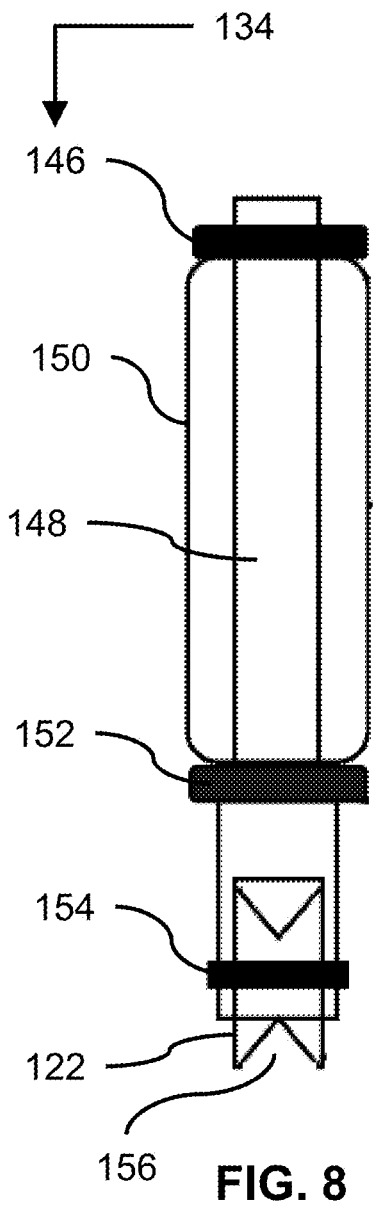
FIGS. 8 and 9 depict side views of embodiments of the wheel lift actuators, and an optional bearing and bushing solid mount system of the arch-support system of FIG. 1.
Figure 9:
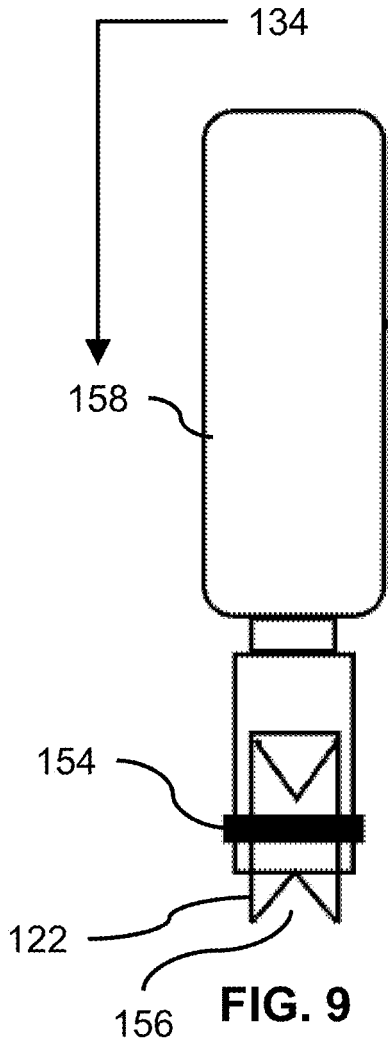

FIGS. 8 and 9 depict side views of embodiments of a wheel lift actuator 134 of the arch-support system 102 of FIG. 1.

Referring to the embodiment as depicted in FIG. 8, the wheel lift actuator 134 includes a shaft lock ring 146 (also called a vertical-movement lock assembly), a wheel support shaft 148 (also called an elongated shaft), and a mounting bushing 150, and a thrust bearing 152. The wheel 122 includes a wheel axle 154, and the wheel 122 defines a wheel v-groove 156 formed along the outer periphery of the wheel 122. The wheel support shaft 148 is inserted or is received in the mounting bushing 150. The mounting bushing 150 is connected to a thrust bearing 152. The wheel 122 is mounted (rotatable mounted) to the thrust bearing 152. The shaft lock ring 146 is mounted to the mounting bushing 150, and the shaft lock ring 146 is configured to selectively lock and prevent vertical movement of the wheel support shaft 148 (when needed).

Referring to the embodiment as depicted in FIG. 9, the wheel lift actuator 134 includes a double-acting cylinder 158 configured to be mounted to the wheel 122, and vertically lift or move, in use, the wheel 122 relative to the rail 120 (depicted in FIG. 5).

Unless otherwise specified, relational terms used in these specifications should be construed to include certain tolerances that the person skilled in the art would recognize as providing equivalent functionality. By way of example the term perpendicular is not necessarily limited to 90.0 degrees, but also to any slight variation thereof that the person skilled in the art would recognize as providing equivalent functionality for the purposes described for the relevant member or element. Terms such as "about" and "substantially", in the context of configuration, relate generally to disposition, location, or configuration that is either exact or sufficiently close to the location, disposition, or configuration of the relevant element to preserve operability of the element within the invention which does not materially modify the invention. Similarly, unless specifically or made clear from its context, numerical values should be construed to include certain tolerances that the person skilled in the art would recognize as having negligible importance as it does not materially change the operability of the invention. It will be appreciated that the description and/or drawings identify and describe embodiments of the apparatus (either explicitly or non-explicitly). The apparatus may include any suitable combination and/or permutation of the technical features as identified in the detailed description, as may be required and/or desired to suit a particular technical purpose and/or technical function. It will be appreciated, that where possible and suitable, any one or more of the technical features of the apparatus may be combined with any other one or more of the technical features of the apparatus (in any combination and/or permutation). It will be appreciated that persons skilled in the art would know that technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the phrase "includes" is equivalent to the word "comprising." The foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

an arch-support system being configured to support an archway above a work surface during construction of the archway while allowing unimpeded movement below the archway during construction of the archway; and the arch-support system, including:

a telescoping base section having an upper base section and a lower base section being spaced apart from the upper base section, in which the lower base section is configured to be securely mounted to the work surface in such a way that the telescoping base section extends upwardly from the work surface once the lower base section is securely mounted to the work surface; and an intermediate section having an upper intermediate section and a lower intermediate section being spaced apart from the upper intermediate section, in which the lower intermediate section is configured to be securely affixed to the upper base section of the telescoping base section in such a way that the intermediate section extends upwardly from the telescoping base section once (A) the lower intermediate section is securely affixed to the upper base section of the telescoping base section, and (B) the lower base section is securely mounted to the work surface; and an arch-support section being configured to be securely affixed to the upper intermediate section of the intermediate section in such a way that the arch-support section is spaced apart from the work surface once the arch-support section is securely affixed to the upper intermediate section of the intermediate section, and the arch-support section being configured to securely support construction of the archway in such a way that the arch-support section is removable from the archway, once construction of the archway is completed and the archway is self-supporting; and a rail assembly being configured to selectively receive and support the telescoping base section in such a way that the rail assembly, in use, supports movement of the telescoping base section relative to the archway once the rail assembly selectively receives the telescoping base section; and the apparatus further comprising:

spaced-apart wheels being affixed to the lower base section of the telescoping base section; and the spaced-apart wheels being configured to make rolling engagement with the rail assembly in such a way that the spaced-apart wheels, in use, permit horizontal rolling movement of the telescoping base section along the rail assembly once the spaced-apart wheels engage the rail assembly; and wherein:

the spaced-apart wheels are further configured to be:

locked in such a way that once the spaced-apart wheels are locked, the telescoping base section is stationary relative to the rail assembly; and unlocked in such a way that once the spaced-apart wheels are unlocked, the telescoping base section is mobile relative to the rail assembly.

2. An apparatus, comprising:

an arch-support system being configured to support an archway above a work surface during construction of the archway while allowing unimpeded movement below the archway during construction of the archway; and the arch-support system, including:

a telescoping base section having an upper base section and a lower base section being spaced apart from the upper base section, in which the lower base section is configured to be securely mounted to the work surface in such a way that the telescoping base section extends upwardly from the work surface once the lower base section is securely mounted to the work surface; and an intermediate section having an upper intermediate section and a lower intermediate section being spaced apart from the upper intermediate section, in which the lower intermediate section is configured to be securely affixed to the upper base section of the telescoping base section in such a way that the intermediate section extends upwardly from the telescoping base section once (A) the lower intermediate section is securely affixed to the upper base section of the telescoping base section, and (B) the lower base section is securely mounted to the work surface; and an arch-support section being configured to be securely affixed to the upper intermediate section of the intermediate section in such a way that the arch-support section is spaced apart from the work surface once the arch-support section is securely affixed to the upper intermediate section of the intermediate section, and the arch-support section being configured to securely support construction of the archway in such a way that the arch-support section is removable from the archway, once construction of the archway is completed and the archway is self-supporting; and a rail assembly being configured to selectively receive and support the telescoping base section in such a way that the rail assembly, in use, supports movement of the telescoping base section relative to the archway once the rail assembly selectively receives the telescoping base section; and the apparatus further comprising:

spaced-apart wheels being affixed to the lower base section of the telescoping base section; and the spaced-apart wheels being configured to make rolling engagement with the rail assembly in such a way that the spaced-apart wheels, in use, permit horizontal rolling movement of the telescoping base section along the rail assembly once the spaced-apart wheels engage the rail assembly; and wherein:

the spaced-apart wheels are attached to spaced-apart wheel lift actuators that are supported by the telescoping base section; and the spaced-apart wheel lift actuators are configured to respectively lower and raise the spaced-apart wheels relative to the rail assembly to allow selective movement of the telescoping base section relative to the archway into a predetermined position, and thereby facilitate the construction of a section of the archway, and also facilitate movement of the telescoping base section for the construction of an additional section of the archway.

3. An apparatus, comprising:

an arch-support system being configured to support an archway above a work surface during construction of the archway while allowing unimpeded movement below the archway during construction of the archway; and the arch-support system, including:

a telescoping base section having an upper base section and a lower base section being spaced apart from the upper base section, in which the lower base section is configured to be securely mounted to the work surface in such a way that the telescoping base section extends upwardly from the work surface once the lower base section is securely mounted to the work surface; and an intermediate section having an upper intermediate section and a lower intermediate section being spaced apart from the upper intermediate section, in which the lower intermediate section is configured to be securely affixed to the upper base section of the telescoping base section in such a way that the intermediate section extends upwardly from the telescoping base section once (A) the lower intermediate section is securely affixed to the upper base section of the telescoping base section, and (B) the lower base section is securely mounted to the work surface; and an arch-support section being configured to be securely affixed to the upper intermediate section of the intermediate section in such a way that the arch-support section is spaced apart from the work surface once the arch-support section is securely affixed to the upper intermediate section of the intermediate section, and the arch-support section being configured to securely support construction of the archway in such a way that the arch-support section is removable from the archway, once construction of the archway is completed and the archway is self-supporting; and a rail assembly being configured to selectively receive and support the telescoping base section in such a way that the rail assembly, in use, supports movement of the telescoping base section relative to the archway once the rail assembly selectively receives the telescoping base section; and the apparatus further comprising:

a bracing assembly being configured to be coupled to the telescoping base section; and the bracing assembly being configured to brace the telescoping base section against a stationary section of the archway in such a way that the bracing assembly, in use, prevents lateral movement of the telescoping base section relative to the work surface; and wherein:

the bracing assembly is affixed to side sections of the telescoping base section; and the bracing assembly is configured to position the telescoping base section relative to the archway; and the bracing assembly is configured to prevent lateral movement of the telescoping base section during construction of the archway.

4. An apparatus, comprising:

an arch-support system being configured to support an archway above a work surface during construction of the archway while allowing unimpeded movement below the archway during construction of the archway; and the arch-support system, including:

a telescoping base section having an upper base section and a lower base section being spaced apart from the upper base section, in which the lower base section is configured to be securely mounted to the work surface in such a way that the telescoping base section extends upwardly from the work surface once the lower base section is securely mounted to the work surface; and an intermediate section having an upper intermediate section and a lower intermediate section being spaced apart from the upper intermediate section, in which the lower intermediate section is configured to be securely affixed to the upper base section of the telescoping base section in such a way that the intermediate section extends upwardly from the telescoping base section once (A) the lower intermediate section is securely affixed to the upper base section of the telescoping base section, and (B) the lower base section is securely mounted to the work surface; and an arch-support section being configured to be securely affixed to the upper intermediate section of the intermediate section in such a way that the arch-support section is spaced apart from the work surface once the arch-support section is securely affixed to the upper intermediate section of the intermediate section, and the arch-support section being configured to securely support construction of the archway in such a way that the arch-support section is removable from the archway, once construction of the archway is completed and the archway is self-supporting; and a rail assembly being configured to selectively receive and support the telescoping base section in such a way that the rail assembly, in use, supports movement of the telescoping base section relative to the archway once the rail assembly selectively receives the telescoping base section; and a bracing assembly being configured to be coupled to the telescoping base section; and the bracing assembly being configured to brace the telescoping base section against a stationary section of the archway in such a way that the bracing assembly, in use, prevents lateral movement of the telescoping base section relative to the work surface; and the bracing assembly including:

a hydraulic cylinder configured to selectively move pivoting arms.

5. An apparatus, comprising:

an arch-support system being configured to support an archway above a work surface during construction of the archway while allowing unimpeded movement below the archway during construction of the archway; and the arch-support system, including:

a telescoping base section having an upper base section and a lower base section being spaced apart from the upper base section, in which the lower base section is configured to be securely mounted to the work surface in such a way that the telescoping base section extends upwardly from the work surface once the lower base section is securely mounted to the work surface; and an intermediate section having an upper intermediate section and a lower intermediate section being spaced apart from the upper intermediate section, in which the lower intermediate section is configured to be securely affixed to the upper base section of the telescoping base section in such a way that the intermediate section extends upwardly from the telescoping base section once (A) the lower intermediate section is securely affixed to the upper base section of the telescoping base section, and (B) the lower base section is securely mounted to the work surface; and an arch-support section being configured to be securely affixed to the upper intermediate section of the intermediate section in such a way that the arch-support section is spaced apart from the work surface once the arch-support section is securely affixed to the upper intermediate section of the intermediate section, and the arch-support section being configured to securely support construction of the archway in such a way that the arch-support section is removable from the archway, once construction of the archway is completed and the archway is self-supporting; and a rail assembly being configured to selectively receive and support the telescoping base section in such a way that the rail assembly, in use, supports movement of the telescoping base section relative to the archway once the rail assembly selectively receives the telescoping base section; and the telescoping base section includes:

a combination of safety lock assemblies and manual and lockable safety shut off valves being configured to prevent accidental movement of the telescoping base section during the construction of the archway.

6. An apparatus, comprising:

an arch-support system being configured to support an archway above a work surface during construction of the archway while allowing unimpeded movement below the archway during construction of the archway; and the arch-support system, including:

a telescoping base section having an upper base section and a lower base section being spaced apart from the upper base section, in which the lower base section is configured to be securely mounted to the work surface in such a way that the telescoping base section extends upwardly from the work surface once the lower base section is securely mounted to the work surface; and an intermediate section having an upper intermediate section and a lower intermediate section being spaced apart from the upper intermediate section, in which the lower intermediate section is configured to be securely affixed to the upper base section of the telescoping base section in such a way that the intermediate section extends upwardly from the telescoping base section once (A) the lower intermediate section is securely affixed to the upper base section of the telescoping base section, and (B) the lower base section is securely mounted to the work surface; and an arch-support section being configured to be securely affixed to the upper intermediate section of the intermediate section in such a way that the arch-support section is spaced apart from the work surface once the arch-support section is securely affixed to the upper intermediate section of the intermediate section, and the arch-support section being configured to securely support construction of the archway in such a way that the arch-support section is removable from the archway, once construction of the archway is completed and the archway is self-supporting; and a rail assembly being configured to selectively receive and support the telescoping base section in such a way that the rail assembly, in use, supports movement of the telescoping base section relative to the archway once the rail assembly selectively receives the telescoping base section; and wherein:

the telescoping base section and the intermediate section each includes:

spaced-apart horizontal beams; and spaced-apart vertical beams being configured to be affixed to the spaced-apart horizontal beams to form a matrix-like support structure; and a cross-supporting structure configured to interconnect between the spaced-apart horizontal beams and the spaced-apart vertical beams to further support components of the telescoping base section.

7. An apparatus, comprising:

an arch-support system being configured to support an archway above a work surface during construction of the archway while allowing unimpeded movement below the archway during construction of the archway; and the arch-support system, including:

a telescoping base section having an upper base section and a lower base section being spaced apart from the upper base section, in which the lower base section is configured to be securely mounted to the work surface in such a way that the telescoping base section extends upwardly from the work surface once the lower base section is securely mounted to the work surface; and an intermediate section having an upper intermediate section and a lower intermediate section being spaced apart from the upper intermediate section, in which the lower intermediate section is configured to be securely affixed to the upper base section of the telescoping base section in such a way that the intermediate section extends upwardly from the telescoping base section once (A) the lower intermediate section is securely affixed to the upper base section of the telescoping base section, and (B) the lower base section is securely mounted to the work surface; and an arch-support section being configured to be securely affixed to the upper intermediate section of the intermediate section in such a way that the arch-support section is spaced apart from the work surface once the arch-support section is securely affixed to the upper intermediate section of the intermediate section, and the arch-support section being configured to securely support construction of the archway in such a way that the arch-support section is removable from the archway, once construction of the archway is completed and the archway is self-supporting; and a rail assembly being configured to selectively receive and support the telescoping base section in such a way that the rail assembly, in use, supports movement of the telescoping base section relative to the archway once the rail assembly selectively receives the telescoping base section; and wherein the telescoping base section further includes:

vertically-extending spaced-apart telescoping tubular sections each including:

an outer tube section; and an inner tube section;

the inner tube section and the outer tube section being engageable with each other; and the apparatus further comprises:

a safety lock assembly with each of a vertically-extending spaced-apart telescoping tubular threaded sections; and the safety lock assembly being configured to selectively prevent vertical height adjustment of the vertically-extending spaced-apart telescoping tubular sections.

8. An apparatus, comprising:

an arch-support system being configured to support an archway above a work surface during construction of the archway while allowing unimpeded movement below the archway during construction of the archway; and the arch-support system, including:

a telescoping base section having an upper base section and a lower base section being spaced apart from the upper base section, in which the lower base section is configured to be securely mounted to the work surface in such a way that the telescoping base section extends upwardly from the work surface once the lower base section is securely mounted to the work surface; and an intermediate section having an upper intermediate section and a lower intermediate section being spaced apart from the upper intermediate section, in which the lower intermediate section is configured to be securely affixed to the upper base section of the telescoping base section in such a way that the intermediate section extends upwardly from the telescoping base section once (A) the lower intermediate section is securely affixed to the upper base section of the telescoping base section, and (B) the lower base section is securely mounted to the work surface; and an arch-support section being configured to be securely affixed to the upper intermediate section of the intermediate section in such a way that the arch-support section is spaced apart from the work surface once the arch-support section is securely affixed to the upper intermediate section of the intermediate section; and the arch-support section being configured to securely support construction of the archway in such a way that the arch-support section is removable from the archway, once construction of the archway is completed and the archway is self-supporting; and spaced-apart lift actuators being affixed to the telescoping base section in such a way that the spaced-apart lift actuators are configured to move the telescoping base section along any one of an upward direction and a downward direction relative to the work surface once the spaced-apart lift actuators are affixed to the lower base section of the telescoping base section; and a rail assembly being configured to contact and extend along the work surface in such a way that the rail assembly extends along the work surface underneath the archway once the rail assembly, in use, contacts the work surface; and the rail assembly is configured to selectively receive and support the telescoping base section in such a way that the rail assembly, in use, supports movement of the telescoping base section relative to the archway once the rail assembly selectively receives the telescoping base section; and spaced-apart wheels being affixed to the lower base section of the telescoping base section; and the spaced-apart wheels being configured to make rolling engagement with the rail assembly in such a way that the spaced-apart wheels, in use, permit horizontal rolling movement of the telescoping base section along the rail assembly once the spaced-apart wheels engage the rail assembly; and the spaced-apart wheels being configured to be locked in such a way that once the spaced-apart wheels are locked, the telescoping base section is stationary relative to the rail assembly; and the spaced-apart wheels being configured to be unlocked in such a way that once the spaced-apart wheels are unlocked, the telescoping base section is mobile relative to the rail assembly; and a bracing assembly being configured to be coupled to the telescoping base section; and the bracing assembly being configured to brace the telescoping base section against a stationary section of the archway in such a way that the bracing assembly, in use, prevents lateral movement of the telescoping base section relative to the work surface.

* * * * *